United States Patent [19]

Miller et al.

[11] 4,139,251

[45] Feb. 13, 1979

[54] WIDE BAND SLIP RING MODULE

[75] Inventors: Robert H. Miller; Eugene A. Manus; Herbert C. Walker, all of Blacksburg; Sherwin L. Brady, Floyd, all of Va.

[73] Assignee: Litton Systems, Inc., Blacksburg, Va.

[21] Appl. No.: 847,739

[22] Filed: Nov. 2, 1977

[51] Int. Cl.[2] ..... H01R 39/00

[52] U.S. Cl. ..... 339/5 M; 310/232

[58] Field of Search ..... 339/5 M, 5 L, 5 P; 310/232

[56] References Cited

U.S. PATENT DOCUMENTS 2,703,868 3/1955 Rausenberger ..... 310/232 X 2,931,999 4/1960 Lemmerman ..... 339/5 M

*Primary Examiner*—Roy Lake

*Assistant Examiner*—DeWalden W. Jones

*Attorney, Agent, or Firm*—Brian L. Ribando

[57] ABSTRACT

In a module which is usable in a wide band DC to UHF range, a vernier connection is employed in a slip ring and brush assembly. A source is connected to a ring by four slip ring feeds and a load is coupled to the ring by three brush leads. The unequal number of feeds and brushes reduces the standing wave reflections on the ring enabling the module to perform satisfactorily at high frequencies.

15 Claims, 4 Drawing Figures

WIDE BAND SLIP RING MODULE

BACKGROUND OF THE INVENTION

The invention relates to a slip ring and brush assembly, and more particularly, to a wide band DC to UHF module in which a vernier connection comprising an unequal number of slip ring feeds and brush leads is employed.

It can be shown that a slip ring assembly which comprises a single feed wire to the slip ring and a single brush lead will exhibit a reflection coefficient of $$P = \frac{(\cos\theta - j\sin\theta)\sin^2(\frac{\theta}{2} - \phi)}{1-(\cos\theta - j\sin\theta)\cos^2(\frac{\theta}{2} - \phi)}.$$

In this equation, $\theta$ equals the ring circumference in radians of transmission line length, and $\phi$ equals the displacement between the slip ring feed and the brush, also expressed in radians. This equation assumes that the characteristic impedance of the slip ring is twice the characteristic impedance of the feed line.

In many applications, a specific slip ring assembly will require a ring of such large diameter, that when operated at a high frequency, the reflection coefficient given by the equation above will be excessive. In such a situation, the use of multiple feeds is helpful. For example, if four brushes and four slip ring feeds are used, the reflection coefficient would be given by the equation above where $\theta$ becomes one-fourth of the slip ring circumference. In this way, for a given reflection coefficient and slip ring diameter, the maximum frequency which can be transmitted would be proportional to the number of feeds and brushes.

If a perfect match of the characteristic impedance could be maintained at each slip ring and brush junction, signals of any frequency could be transmitted by a slip ring of any diameter through the use of a sufficiently large number of feeds and brushes. However, since the slip ring feeds must be connected in parallel at the source, and the brush leads must be connected in parallel at the load, then a perfect impedance match would require that the characteristic impedance of the leads to be N times the system impedance, where N is the number of feeds and brushes. Since a proper impedance match requires that the slip ring impedance be twice the impedance of the feed and brush leads, a proper match is impossible where more than a very few feeds are used. Although a reasonable mismatch is acceptable, a point is rapidly reached where the addition of more feeds would exacerbate the mismatch at the ring in an amount sufficient to prevent any improvement in the reflection coefficient.

An improvement in the minimum value of the reflection coefficient may be obtained through the use of an unequal number of brushes and ring feeds. Such an arrangement may be called a vernier connection. It will be noted that, according to equation 1, the reflection coefficient is a periodic function of $\phi$, reaching a maximum when $\phi$ equals zero, and becoming zero when $\phi$ equals $\theta/2$. When an equal number of feeds and brushes are used, $\phi$ is the same relative to all of the feeds, and consequently, maximum reflection occurs at each of the ring connections simultaneously with a given slip ring position. Where $\phi$ equals $\theta/2$, the reflection is zero.

In the case of a vernier connection, a first number of ring feeds are approximately equally spaced around the circumference of the ring and a second number of brushes are approximately equally spaced around the circumference of the ring. This is to be distinguished from a slip ring construction in which multiple connections of ring feeds and brushes are used for realizing increased current capacity or for reliability based upon reduncancy. In such construction, the ring feeds and brushes are not spaced around the ring and consequently there is no vernier effect. In a true vernier connection, however, where one ring feed is directly under a brush, $\phi$ equals zero and a maximum reflection occurs, but the other feeds are removed from the brushes by varying amounts. This results in smaller reflections occurring at these other feeds. Since the maximum reflection never occurs on all feeds simultaneously, the overall maximum reflection is reduced, and while the minimum reflection may not be zero, the net result is an averaging of the individual reflections on the ring. Since a limiting factor is the value of maximum reflection which occurs with a given slip ring construction, and the reflection coefficient is a function of frequency, a ring using a vernier connection is able to operate at a higher frequency than a ring using conventional multiple connections. A vernier connection produces a reduction of the maximum reflection coefficient as well as a reflection coefficient which is more nearly independent of shaft rotation due to the averaging effect. No such arrangement is known in the prior art.

SUMMARY AND OBJECTS OF THE INVENTION

In accordance with the present invention, a module is provided which is designed for use in a wide band DC to UHF range. An inner ring and an outer ring are concentrically mounted to one another to create a housing for a slip ring assembly which shields the ring from stray interfering signals. The inner and outer rings are rotatable with respect to one another, and the inner ring includes four slip ring feeds while the outer ring includes three brush leads. The brushes are in contact with a high frequency slip ring. The unequal number of slip ring feeds and brush leads reduces the standing wave reflections on the ring enabling the module to perform satisfactorily at high frequencies although the dimensions of the assembly are an appreciable fraction of the wave length of the transmission frequencies which may be used. Physical wiping contact of the brush leads on the slip ring allow the assembly to be used with a D.C. signal.

It is, therefore, an object of the invention to provide a slip ring module which is usable over a large frequency range.

It is another object of the invention to provide a slip ring module which is usable in the DC to UHF range in which the standing waves in the assembly are reduced to an acceptable level.

It is another object of the invention to provide a slip ring module which is usable in the DC to UHF range in which an unequal number of slip ring feeds and brush leads comprise a vernier connection in the ring.

These and other objects of the invention will become apparent from the following detailed description taken in connection with the accompanying drawing figures in which like reference numerals designate like or corresponding parts throughout the figures.

DESCRIPTION OF THE PREFERRED EMBODIMENT

Figure 1:
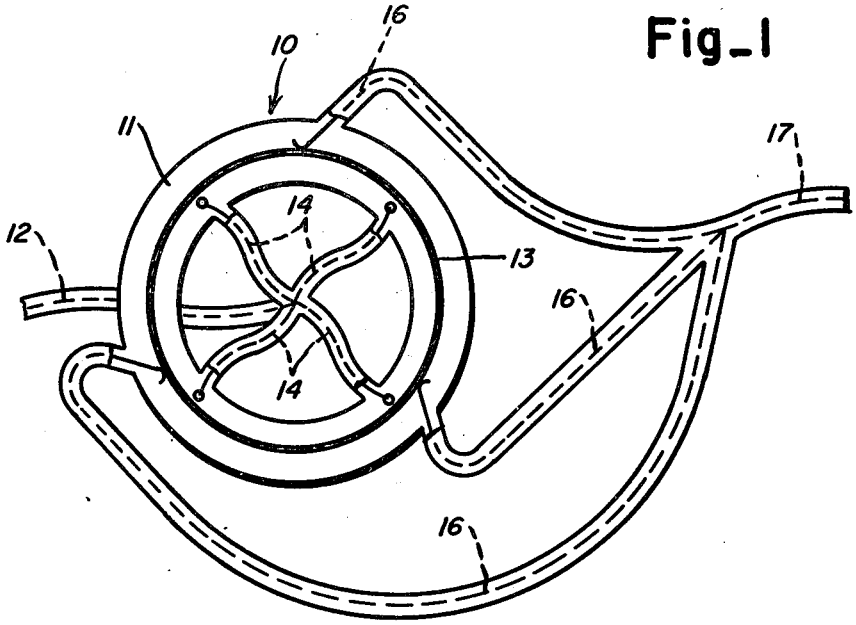
FIG. 1 is a schematic showing of a slip ring module.

Referring now to the drawings, there is shown in FIG. 1, a slip ring assembly generally designated by reference numeral 10. The assembly 10 comprises a housing 11 which is connected by a signal carrier 12 to a source of signals (not shown). The signal carrier 12 is coupled to a high frequency ring 13 by a plurality of parallel connected slip ring feeds 14. The high frequency ring 13 is contacted by a plurality of brush leads 16. The leads 16 are connected in parallel to a common signal carrier 17. The signal carriers may be chosen to have a characteristic impedance of 50 ohms, and the high frequency ring 13 may be chosen to have a characteristic impedance of 300 ohms.

Figure 2:
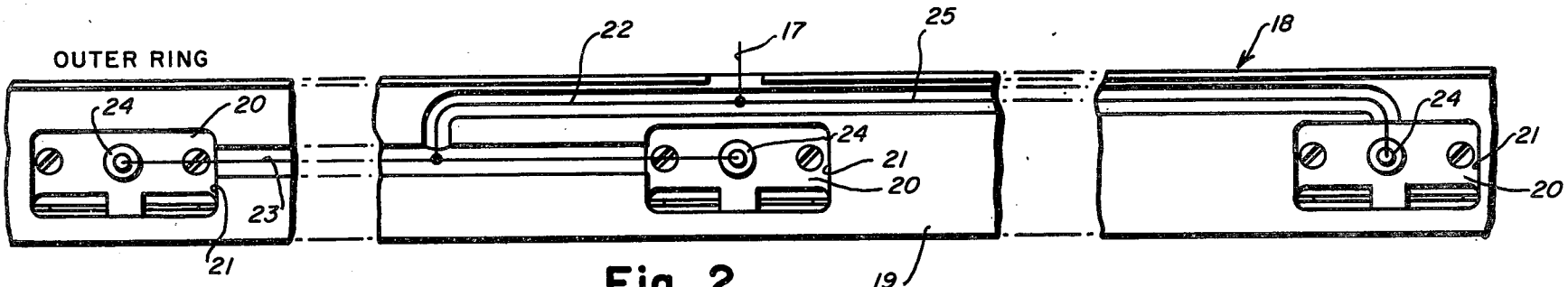
FIG. 2 is a layout view, broken, of the outer ring of a slip ring module.

Turning now to FIG. 2, there is shown in layout, partly broken, a portion of an outer ring, generally indicated at 18, of the housing 11. The portion comprises an outer mounting member 19 in which are formed a plurality of recesses 21. Each recess 21 receives a brush lock assembly 20. Further, the outer mounting member 19 acts as a support for transmission line sections 22, 23 and 25. The electrical connections between the line sections 22, 23 and 25 with the external line 17 can be thought of as one which is tree like. The external line 17 is the trunk of the tree and the line sections 22, 23 and 25 branch therefrom. The characteristic impedance of each of the lines is chosen so that an impedance match is obtained at each of the junctions. For example, where the characteristic impedance of the external line 17 is 50 ohms, the characteristic impedance of lines 22, 23 and 25 will be 75 ohms, 150 ohms, and 150 ohms, respectively. It will be noted that using such impedance values, the parallel impedance of the line sections 23 which are joined with the line section 22 equals 75 ohms, and that the parallel impedance of the line sections 22 and 25 which join with the line section 17 is 50 ohms. The transmission line sections 22, 23 and 25 pass through the outer mounting member 19 and are insulated and spaced therefrom by means of brush insulators 24. It should be remembered that the member 19 is shown diagrammatically and that in the assembly 10 the member 19 is annular in shape.

Figure 3:
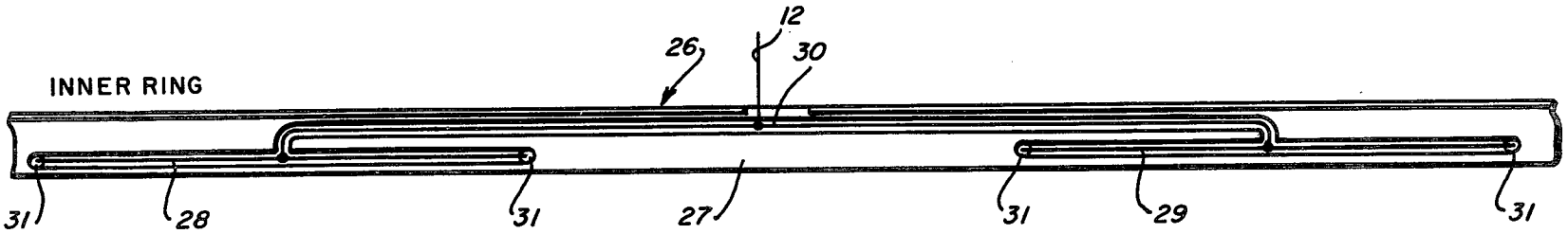
FIG. 3 is a layout view of the inner ring of a slip ring module.

Turning now to FIG. 3, there is shown in layout a portion of an inner ring indicated generally at 26 of the housing 11. The portion 26 comprises an inner mounting member 27 on which are located transmission line sections 28, 29 and 30. The electrical connection between these sections 28, 29 and 30, and the external line 12 may also be thought of as being tree like, where line 12 is the trunk of the tree and sections 30, 28 and 29 branch therefrom. The characteristic impedance of these line sections are chosen so that the parallel combination of the branching sections are matched impedance wise with the trunk section. The transmission line sections 28 and 29 are chosen to have a characteristic impedance of 200 ohms, and the transmission section 30 is chosen to have a characteristic impedance of 100 ohms. The ends of the transmission line section 30 are electrically connected to the midpoints of the transmission line sections 28 and 29. The ends of transmission line sections 28 and 29 pass through the member 27 and are insulated therefrom by means of insulating bushings 31. As in FIG. 2, FIG. 3 shows the invention in diagramatic form only and in actual practice, the inner mounting member is annular in shape.

Figure 4:
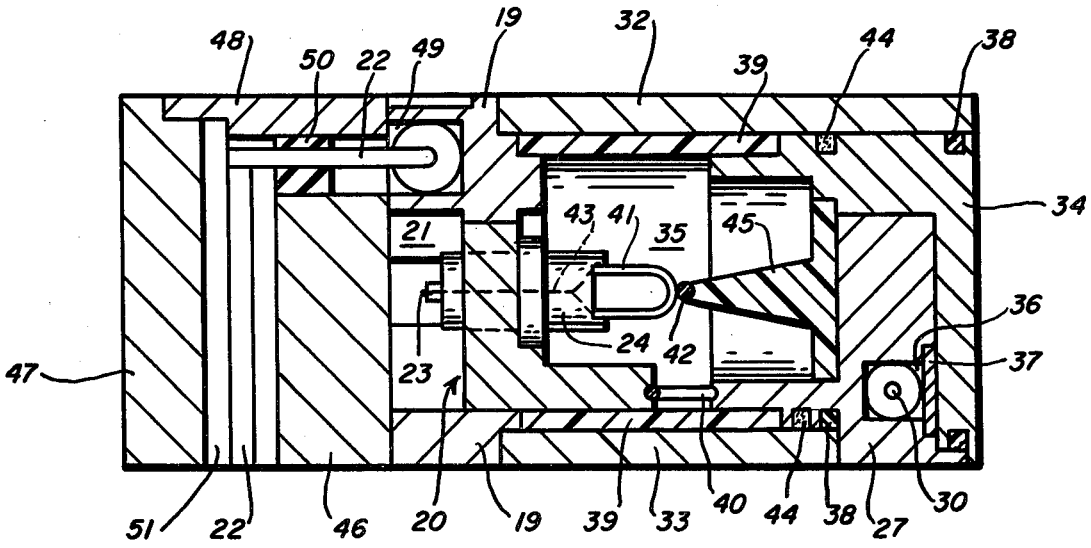
FIG. 4 is a sectional view of the slip ring module of FIG. 1.

Turning now to FIG. 4, a view of the assembled inner and outer housing rings of the high frequency module is shown. Attached to the member 19 are annular retainers 32 and 33. These retainers together with an inside ring member 34, the member 27, and the member 19 define a central cavity 35. The inside ring member 34 is attached to the inner mounting member 27. The transmission line section 30 is disposed in a channel 36, and a channel cover 37 is disposed thereover. Grooves are cut into the side surfaces of the inner mounting member 27 and the inside ring member 34 and these grooves receive Teflon rods 38 which act as bearing surfaces between the members 27 and 34 and the retainers 32 and 33. Additional bearing surfaces are formed by the washers 39. Electrical continuity is maintained between the member 27 and the brush block assembly 20 by a ground brush 40. A signal brush 41 is supported from the brush insulator 24 so as to be in wiping contact with a high frequency ring conductor 42. The conductor 42 is positioned within the cavity 35 by a peaked insulating support 45 which is rigidly fixed to the member 27. The support 45 may be formed of material such as plastic, and a plurality of such supports are formed along the annular surface of the member 27. The supports 45 maintain the conductor in a position so as to be continually in wiping contact with the plurality of signal brushes. A coupling member 43 electrically connects the signal brush 41 to the transmission line 23. Channels 44 are provided at the sliding interface between the members 27 and 34 and the retainers 32 and 33, and these channels 44 are filled with a conductive grease to maintain the electrical integrity of the structure. The recess 21 is covered by an outer ring 46 with an integral connector base 47. A cover 48 completes the structure of the housing 11. A channel 49 is provided for the transmission line section 22. This section 22 is led through an insulating plug 50 and thereafter through a channel 51 to the side surface of the housing. Connection may be made by a suitable connector, not shown, to a signal carrier such as carrier 17.

As shown and described, the high frequency module comprises inner and outer ring assemblies which are rotatable relative to one another. A high frequency ring conductor is positioned within an annular cavity formed by these rings, and this conductor is contacted by a plurality of signal brush elements. The construction of the housing elements may be of a conductive metal, such as brass, in which case the housing shields the cavity and the signal conductor therein from extraneous noise signals. Electrical continuity of the housing is maintained by means of ground brushes and rings of conductive grease held in annular channels. Because the signal brushes are in wiping contact with the ring conductor, the module is operative with D.C. signals. Because the plurality of brush leads and slip ring feeds are distributed as in a vernier scale, the total reflection along the ring is minimized and the module is useful with high frequency signals, such as in the UHF range.

The characteristic impedance of each of the various transmission line sections, the external line sections, the brush leads, the slip ring feeds, the conductive slip ring itself is chosen so that the characteristic impedance of parallel combination of the various sections will be equal to or nearly equal to one-half the characteristic impedance of the slip ring. Where two or more lines are connected in parallel, the sum of the reciprocals of the characteristic impedances of the lines will equal the reciprocal of the sum of the characteristic impedance of the parallel connection. Such a parallel connection may be thought of as being tree like, where a trunk divides into branches, and the sum of the reciprocal of the characteristic impedances of the branches equals the reciprocal of the characteristic impedance of the trunk.

While the invention has been described as a high frequency module comprising four slip ring feeds and three brush leads, the specific number of feeds and leads is not to be limited thereto. It is contemplated, however, that the number of ring feeds be different than the number of brush leads. The number of brush leads may be greater than the number of ring feeds.

Other modifications and departures from the preferred embodiment above described will occur to those skilled in the art, which modifications and departures are intended to be within the scope of the invention as defined in the claims.

We claim:

1. A slip ring assembly for transmitting signals in a wide band DC to UHF frequency range from a source to a load, the assembly comprising:

a slip ring of conductive material, a first number of slip ring feeds connected to said slip ring, said feeds being spaced around the circumference of said ring, a second number of brush leads coupled to said slip ring, said second number being different than said first number and said leads being spaced around the circumference of said ring to form a vernier connection with said feeds, and an annular housing surrounding said assembly and forming a module.

2. The assembly of claim 1 further comprising:

first and second transmission line sections connected to said slip ring feeds, a third transmission line section connected to the midpoints of said first and second transmission line sections, a fourth transmission line section connected to two of said brush leads, and a fifth transmission line section connected to one of said brush leads to the midpoint of said fourth transmission line section.

3. The assembly of claim 2 further comprising:

said first and second transmission line sections having equal impedances, said third transmission line section having an impedance which is half the impedance of said first and second transmission line sections, and said fifth transmission line section, having an impedance which is greater than half but less than the impedance of said fourth transmission line section.

4. The assembly of claim 2 further comprising:

an inner mounting member supporting said first, second and third transmission line sections, an outer mounting member supporting said fourth and fifth transmission line sections, and said brush leads, a support for said slip ring fixed to said inner mounting member, and brush block assembly means supported on said outer mounting member for positioning said brush leads in wiping contact with said slip ring.

5. The assembly of claim 4 further comprising:

a ground brush supported by said brush block assembly in wiping contact with said inner mounting member, first and second annular retainers fixed to said outer member and enclosing at least a portion of said inner mounting member, and means for maintaning an electrically conductive path between said annular retainers and said inner mounting member.

6. The assembly of claim 5 further comprising:

a first channel formed in said inner mounting member and receiving said first, second and third transmission line sections, a second channel formed in said outer mounting member and receiving said fourth and fifth transmission line sections, and means for covering said first and second channels.

7. The assembly of claim 6 further comprising:

an inside ring member fixed to said inner mounting member, and bearing members between said annular retainers and the combination of said inside ring member and said inner mounting member for enhancing relative rotational ability therebetween.

8. The assembly of claim 1 further comprising:

an inner mounting member for supporting said slip ring and said slip ring feeds, and an outer mounting member supporting said brush leads.

9. The assembly of claim 8 further comprising:

a ground brush supported by said brush block assembly in wiping contact with said inner mounting member, first and second annular retainers fixed to said outer member and enclosing at least a portion of said inner mounting member, and means for maintaining an electrically conductive path between said annular retainers and said inner mounting member.

10. The assembly of claim 1 further comprising:

a first number of transmission line sections connected to said slip ring feeds and having equal characteristic impedance, said transmission line sections being connected in a tree like fashion to an external transmission line, wherein at every junction of said tree the characteristic impedances are chosen so that the sum of the reciprocals of the branch impedances is equal to the reciprocal of the trunk impedance.

11. The assembly of claim 10 further comprising:

a second number of transmission line sections connected to said brush leads and having equal characteristic impedance, said transmission line sections being connected in a tree like fashion to an external transmission line, wherein at every junction of said tree the characteristic impedances are chosen so that the sum of the reciprocals of the branch impedances is equal to the reciprocal of the trunk impedance.

12. The assembly of claim 11 further comprising:

a slip ring having a characteristic impedance approximately equal to twice the characteristic impedance of said first and second number of transmission line sections.

13. The assembly of claim 12 further comprising:

an inner mounting member supporting said first number of transmission line sections, an outer mounting member supporting said second number of transmission line sections, a support for said slip ring fixed to said inner mounting member, and brush block assembly means supported on said outer mounting member for positioning said brush leads in wiping contact with said slip ring.

14. The assembly of claim 13 further comprising:

a ground brush supported by said brush block assembly in wiping contact with said inner mounting member, first and second annular retainers fixed to said outer member and enclosing at least a portion of said inner mounting member, and means for maintaining an electrically conductive path between said annular retainers and said inner mounting member.

15. The assembly of claim 14 further comprising:

a first channel formed in said inner mounting member and receiving said first number of transmission line sections, a second channel formed in said outer mounting member and receiving said second number of transmission line sections, and means for covering said first and second channels.

* * * * *